US010159292B2

(12) United States Patent
Ahn et al.

(10) Patent No.: US 10,159,292 B2
(45) Date of Patent: Dec. 25, 2018

(54) APPLICATORS FOR ARTIFICIAL EYELASHES AND KITS FOR APPLYING ARTIFICIAL EYELASHES

(71) Applicant: Kiss Nail Products, Inc., Port Washington, NY (US)

(72) Inventors: Ki-chul Ahn, Port Washington, NY (US); Kyu-sang Han, Port Washington, NY (US); Sung-an Chae, Levittown, NY (US); Won-seok Oh, Port Washington, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 0 days.

(21) Appl. No.: 14/667,119

(22) Filed: Mar. 24, 2015

(65) Prior Publication Data

US 2015/0216246 A1 Aug. 6, 2015

Related U.S. Application Data

(63) Continuation-in-part of application No. 13/736,572, filed on Jan. 8, 2013, which is a continuation-in-part of application No. 13/335,306, filed on Dec. 22, 2011.

(51) Int. Cl.
*A41G 5/02* (2006.01)
*A45D 2/48* (2006.01)

(52) U.S. Cl.
CPC . *A41G 5/02* (2013.01); *A45D 2/48* (2013.01)

(58) Field of Classification Search
CPC ..... A41G 5/02; A41G 44/00; A41G 5/0086; A45D 2/48; A45D 26/0023; A45D 26/0066; A45D 2200/25
USPC ..... 248/316.1, 316.5, 316.7; 132/216, 217, 132/218, 333, 53
See application file for complete search history.

(56) References Cited

U.S. PATENT DOCUMENTS 2,268,082 A * 12/1941 Phillips, Sr. ..... A41G 5/02 132/53
2,392,694 A * 1/1946 Rector ..... A45D 2/48 132/217
2,527,726 A 10/1950 Hendrix
(Continued)

FOREIGN PATENT DOCUMENTS

KR 200165452 2/2000
WO WO 2015181782 * 12/2015 ..... A45D 2/48

OTHER PUBLICATIONS

International Search Report for International Application No. PCT/US2014/010700, dated Apr. 15, 2014.
(Continued)

*Primary Examiner* — Tatiana Nobrega
(74) *Attorney, Agent, or Firm* — Hunton Andrews Kurth LLP

(57) ABSTRACT

The present disclosure relates to an applicator for artificial eyelashes and a kit for applying artificial eyelashes. The applicator includes a first leg, a second leg rotatably coupled to the first leg at a hinge joint, a first body portion connected to the first leg, and a second body portion connected to the second leg. The first body portion includes a first flange positioned opposite the hinge joint, and the second body portion includes a second flange positioned opposite the hinge joint. The first flange matingly receives the second flange when the second leg is rotated toward the first leg.

21 Claims, 15 Drawing Sheets

(56) References Cited

U.S. PATENT DOCUMENTS

| | | | | | |
|---|---|---|---|---|---|
| 2,760,264 | A | | 8/1956 | Javits | |
| 3,315,689 | A | | 4/1967 | Melik | |
| 3,333,593 | A | | 8/1967 | McGivern | |
| 3,392,727 | A | * | 7/1968 | Hanlon | A61B 17/30 24/499 |
| 3,447,542 | A | | 6/1969 | McCullough | |
| D215,821 | S | | 11/1969 | Aylott | |
| 3,478,754 | A | | 11/1969 | Martin, Jr. | |
| 3,504,682 | A | | 4/1970 | Aylott | |
| 3,517,673 | A | | 6/1970 | Kim | |
| 3,547,135 | A | * | 12/1970 | Roos | A41G 5/02 132/216 |
| 3,556,113 | A | | 1/1971 | Frieder | |
| 3,561,454 | A | | 2/1971 | O'Connell | |
| 3,570,662 | A | | 3/1971 | Polyak | |
| 3,625,229 | A | * | 12/1971 | Silson | A41G 5/02 132/216 |
| 3,703,180 | A | * | 11/1972 | Aylott | A41G 5/02 132/216 |
| 3,828,803 | A | * | 8/1974 | Windsor | A45D 44/00 132/216 |
| 3,935,872 | A | * | 2/1976 | Aylott | A41G 5/02 132/216 |
| 4,018,336 | A | * | 4/1977 | Aylott | A41G 5/02 132/216 |
| 4,554,935 | A | | 11/1985 | Hokama | |
| 4,807,650 | A | * | 2/1989 | Bliss | A45D 44/12 132/319 |
| 5,377,700 | A | * | 1/1995 | Harris | A45D 2/48 132/216 |
| 5,678,273 | A | | 10/1997 | Porcelli | |
| 6,029,674 | A | | 2/2000 | Han | |
| 6,308,716 | B1 | | 10/2001 | Han | |
| 7,416,358 | B2 | | 8/2008 | Legendre | |
| 8,196,591 | B2 | | 6/2012 | Lee et al. | |
| 8,424,542 | B1 | * | 4/2013 | Han | A45C 11/00 132/212 |
| 8,561,622 | B1 | | 10/2013 | Sanchez | |
| 2002/0106609 | A1 | * | 8/2002 | Palermo | A61C 3/10 433/159 |
| 2002/0124865 | A1 | | 9/2002 | Davis | |
| 2005/0166939 | A1 | * | 8/2005 | Stroud | A45D 40/30 132/216 |
| 2010/0018545 | A1 | | 1/2010 | Franklin et al. | |
| 2011/0073125 | A1 | | 3/2011 | Iosilevich | |
| 2011/0079236 | A1 | | 4/2011 | Lee et al. | |
| 2011/0174328 | A1 | | 7/2011 | Cerutti et al. | |

OTHER PUBLICATIONS

Written Opinion for International Application No. PCT/US2014/010700, dated Apr. 15, 2014.

* cited by examiner

APPLICATORS FOR ARTIFICIAL EYELASHES AND KITS FOR APPLYING ARTIFICIAL EYELASHES

PRIORITY CLAIM

The present application is a Continuation-In-Part of U.S. patent application Ser. No. 13/736,572, filed on Jan. 8, 2013, which is a Continuation-In-Part of U.S. patent application Ser. No. 13/335,306, filed on Dec. 22, 2011, the contents of each of which are incorporated herein by reference.

FIELD OF TECHNOLOGY

The present disclosure relates generally to cosmetic items, and, more particularly, to applicators for artificial eyelashes and kits for applying artificial eyelashes.

BACKGROUND

As an alternative to or in addition to mascara, eyelash lengthening, darkening or thickening may be accomplished by attaching artificial eyelashes to a user's eyelids to enhance the appearance of eyelashes. Such artificial eyelashes are generally secured to the user's eyelids by an adhesive.

The artificial eyelashes may be manually applied to an eyelid with the user's fingers. Specifically, an artificial eyelash may be gripped by the fingers, bent to a selected curvature, and applied to the eyelid. Applicators have been introduced for use in artificial eyelash application. Effective application requires the proper adjustment for curvature of the user's eyelid, and also requires accurate placement of the artificial eyelash. However, typically, the location of the user's hands, fingers and the applicator, which are proximate to the user's eye during application, may obstruct the user's view in a mirror, making proper placement of the artificial eyelash difficult.

The adhesive used to secure the artificial eyelash to the user's eyelid can adhere to the user's fingers and/or the applicator, requiring excessive handling of the artificial eyelash and causing unwanted distortion and bending of the artificial eyelash. Existing applicator devices also do not adequately allow for effective application of the artificial eyelash on different eye shapes.

SUMMARY

The present disclosure has been made to address at least the above problems and/or disadvantages and to provide at least the advantages described below. Accordingly, aspects of the present disclosure provide applicators for artificial eyelashes and kits for applying artificial eyelashes.

One non-limiting aspect of the present disclosure is directed to an applicator for artificial eyelashes including a first leg, a second leg coupled to the first leg at a hinge joint, a first body portion connected to the first leg, and a second body portion connected to the second leg. The first body portion includes a first flange positioned opposite the hinge joint. A set of artificial eyelashes is disposed on the first flange. The second body portion includes a second flange positioned opposite the hinge joint. A coupling mechanism is mounted to at least one of the first and second legs. The coupling mechanism releasably locks the first and second legs together. The first flange matingly receives the second flange with the set of artificial eyelashes positioned therebetween when the first and second legs are locked together.

Another non-limiting aspect of the present disclosure is directed to a kit for applying artificial eyelashes including a packaging tray and at least one applicator for artificial eyelashes removably coupled to the packaging tray. The at least one applicator includes a first leg, a second leg coupled to the first leg at a hinge joint, a first body portion connected to the first leg, and a second body portion connected to the second leg. The first body portion includes a first flange opposite the hinge joint. A set of artificial eyelashes is disposed on the first flange. The second body portion includes a second flange opposite the hinge joint. The first flange matingly receives the second flange with the set of artificial eyelashes positioned therebetween when the second leg is rotated toward the first leg.

Another non-limiting aspect of the present disclosure is directed to an applicator for artificial eyelashes including a first leg, a second leg rotatably coupled to the first leg at a hinge joint, a first body portion connected to the first leg, and a second body portion connected to the second leg. The first body portion includes a first flange positioned opposite the hinge joint, and the second body portion includes a second flange positioned opposite the hinge joint. The first flange matingly receives the second flange when the second leg is rotated toward the first leg.

Another non-limiting aspect of the present disclosure is directed to an applicator for artificial eyelashes including a substantially planar body portion, a flange coupled to the body portion, and at least one leg coupled to the body portion opposite the flange. The flange defines a concave arc to support a set of artificial eyelashes. The at least one leg is angled away from the body portion.

Another non-limiting aspect of the present disclosure is directed to a kit for artificial eyelashes including a packaging tray and at least one applicator for artificial eyelashes removably coupled to the packaging tray. The at least one applicator includes a substantially planar body portion, a flange coupled to the body portion, at least one leg coupled to the body portion opposite the flange. The flange defines a concave arc to support a set of artificial eyelashes. The at least one leg is angled away from the body portion.

BRIEF DESCRIPTION OF THE DRAWINGS

The above and other aspects, features and advantages of the present disclosure will be more apparent from the following detailed description when taken in conjunction with the accompanying drawings, in which.

Figure 2:
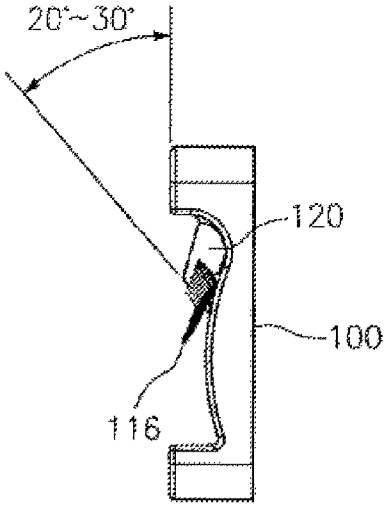
FIG. 2 is a diagram illustrating a side view of the packaging tray for artificial eyelashes, according to an embodiment of the present disclosure.

The reader will appreciate the foregoing details, as well as others, upon considering the following detailed description of certain non-limiting embodiments of applicators and kits according to the present disclosure. The reader also may comprehend certain of such additional details upon using the applicators and kits described herein.

DETAILED DESCRIPTION

Embodiments of the present disclosure are described in detail with reference to the accompanying drawings. The same or similar components may be designated by the same or similar reference numerals although they are illustrated in different drawings. Detailed descriptions of constructions or processes known in the art may be omitted to avoid obscuring the subject matter of the present disclosure. Further, in the following description of the present disclosure, various specific definitions found in the following description are provided only to provide a general understanding of the present disclosure, and it is apparent to those skilled in the art that the present disclosure can be implemented without such definitions.

Figure 1:
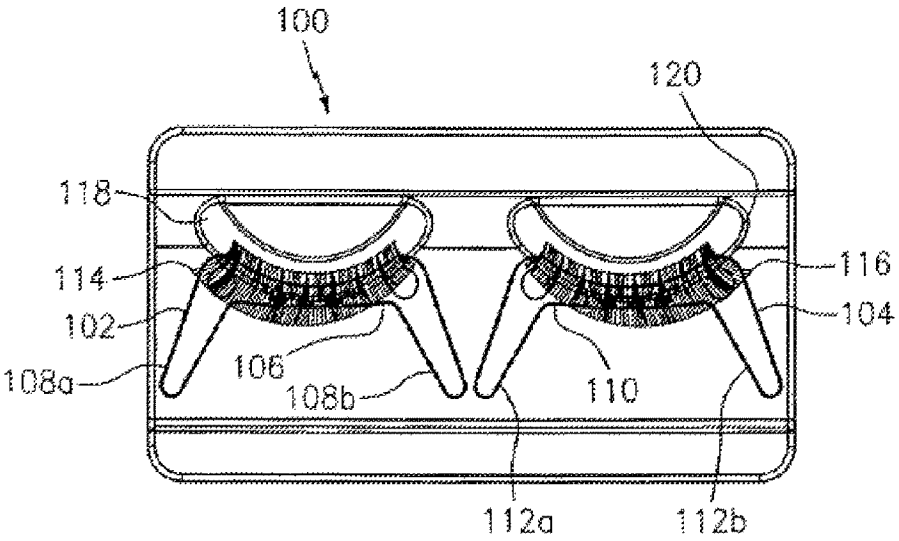
FIG. 1 is a diagram illustrating a top view of a packaging tray for artificial eyelashes, according to an embodiment of the present disclosure.

Referring initially to FIG. 1, a diagram illustrates a top view of a packaging tray 100 for artificial eyelashes, according to an embodiment of the present disclosure. A top surface of the packaging tray 100 of FIG. 1 includes first and second integrated artificial eyelash applicators 102 and 104. The first and second artificial eyelash applicators 102 and 104 are attached to the packaging tray 100 and lie in-line with the contours are of the top surface of the packaging tray 100. While the embodiment of the present disclosure illustrated in FIG. 1 shows two artificial eyelash applicators, any number of artificial eyelash applicators may be integrated into the top surface of the packaging tray 100. First artificial eyelash applicator 102 has a first main body 106 and two corresponding legs 108*a* and 108*b*, while second artificial eyelash applicator 104 has a second main body 110 and two corresponding legs 112*a* and 112*b*. The corresponding legs 108*a*, 108*b*, 112*a* and 112*b* extend in substantially the same direction from one of the main bodies 106 and 110. While the embodiment of the present disclosure illustrated in FIG. 1 shows artificial eyelash applicators having two legs, any number of legs may be provided that also allow for proper application of the artificial eyelash. Further, the main bodies 106 and 110 are shown having a slightly concave curvature that results in a slight wishbone shape of the first and second artificial eyelash applicators 102 and 104.

First and second artificial eyelashes 114 and 116 are disposed on and temporarily adhered to the main bodies 106 and 110 of the first and second artificial eyelash applicators 102 and 104, respectively. Base portions of the first and second artificial eyelashes 114 rest on first and second contoured projections 118 and 120 of the packaging tray 100. The first and second contoured projections 118 and 120 are disposed on a side of the main bodies 106 and 110 opposite that from which the corresponding legs 108*a*, 108*b*, 112*a* and 112*b* extend.

Both the packaging tray 100 and the integrated artificial eyelash applicators 102 and 104 may be composed of a synthetic or semi-synthetic organic solid, such as, for example, a lightweight or thin plastic or polymer.

Referring now to FIG. 2, a diagram illustrates a side view of the packaging tray 100, according to an embodiment of the present disclosure. The second artificial eyelash 116 is disposed on the second artificial eyelash applicator 104 in a specific position. The second contoured projection 120 of the packaging tray 100 supports this specific position of the artificial eyelash 116. More specifically, in this embodiment of the present disclosure, an angle from which the second artificial eyelash 116 extends from its own base is preferably approximately 20-30 degrees from a vertical line representing the top surface of the packaging tray 100. Accordingly, a front surface of the second contoured projection 120 that supports the base of the second artificial eyelash 116 is also angled at 20-30 degrees from the vertical line of the packaging tray 100. The first artificial eyelash 114 and the first contoured projection 118 are angled in a similar manner. This angled disposition of the first and second artificial eyelashes 114 and 116 allows for proper display when the first and second contoured projections 118 and 120 are envisioned as the eyelids of the user. Further, this angled disposition maintains the first and second artificial eyelashes 114 and 116 in the proper shape so that they are not damaged within the packaging.

Figure 3:
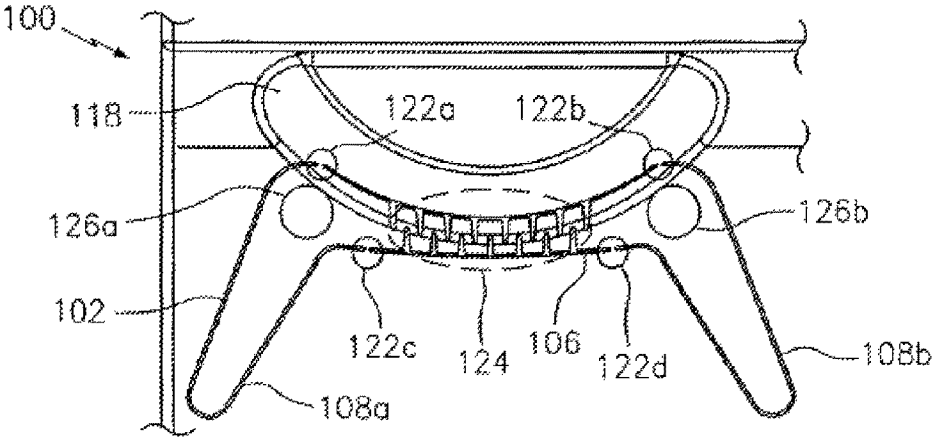
FIG. 3 is a diagram illustrating an artificial eyelash applicator integrated with the packaging tray, according to an embodiment of the present disclosure.

FIG. 3 is a diagram that illustrates the first artificial eyelash applicator 102, according to an embodiment of the present disclosure. FIG. 3 provides a view of the first artificial eyelash applicator 102 prior to application of the first artificial eyelash 114. As described above with respect to FIG. 1, the first artificial eyelash applicator 102 includes the first main body 106 and two corresponding legs 108*a* and 108*b*. The second eyelash applicator 104 has a configuration that is substantially identical to that described herein with respect to FIG. 3.

The first artificial eyelash applicator 102 is integrated with the packaging tray 100 through four attachment points 122*a*-122*d*. The remaining portions and edges of the first artificial eyelash applicator 102 are detached from the packaging tray 100. The four attachment points 122*a*-122*d* are preferably disposed on each side of the first main body 106 proximate to an area where the corresponding legs 108*a* and 108*b* meet the first main body 106. The four attachment points 122*a*-122*d* maintain the first artificial eyelash applicator 102 in-line with the contours of the packaging tray 100. The first artificial eyelash applicator 102 is removed from the packaging tray by breaking the four attachment points 122*a*-122*d*. While this embodiment of the present disclosure illustrates four attachment points 122*a*-122*d*, any number of connection points may be utilised that maintain the artificial eyelash applicator 102 in the proper position with respect to this embodiment and also allow for removal of the artificial eyelash applicator 102 from the packaging tray 100.

The first artificial eyelash applicator 102 also includes a flexible region 124. The flexible region 124 is disposed in a central portion of the first main body 106. In a preferred embodiment of the present disclosure, the flexible region 124 is cut to an accordion shape so that the first artificial eyelash applicator 102 is easily bent when the first artificial eyelash applicator 102 is being used to apply the first artificial eyelash 114, which will be described in greater detail below with reference to FIG. 10.

Further, with respect to FIG. 3, the first artificial eyelash applicator 102 is shown to include a portion of the first contoured projection 118. More specifically, when the first artificial eyelash applicator 102 is removed from the packaging tray 100 a portion of the first contoured projection is also removed. Thus, the main body 106 of the first artificial eyelash applicator 102 includes both a substantially horizontal portion and a substantially vertical portion, which form a ledge-like shape. This shape of the main body 106 allows for easier retention of the first artificial eyelash 114, when the artificial eyelash applicator 102 is being used and the first artificial eyelash 114 is being applied.

The main body 106 of the first artificial eyelash applicator 102 also includes first and second corner regions 126*a* and 126*b*. The first corner region 126*a* is disposed at a portion of the first main body 106 that meets the first leg 108*a*, and the second corner region 126*b* is disposed at a portion of the first main body 106 that meets the second leg 108*b*. Adhesive is applied at both the first and second corner regions 126*a* and 126*b* for temporary adhesion of the first artificial eyelash 114 to the first main body 106 of the first artificial eyelash applicator 102. Adhesive may be applied to a top surface of the main body 106 in the first and second corner regions 126*a* and 126*b*, or adhesive may be applied from a bottom surface of the main body 106 through apertures in the first and second corner regions 126*a* and 126*b*, as described in greater detail below with reference to FIG. 8.

Figure 4:
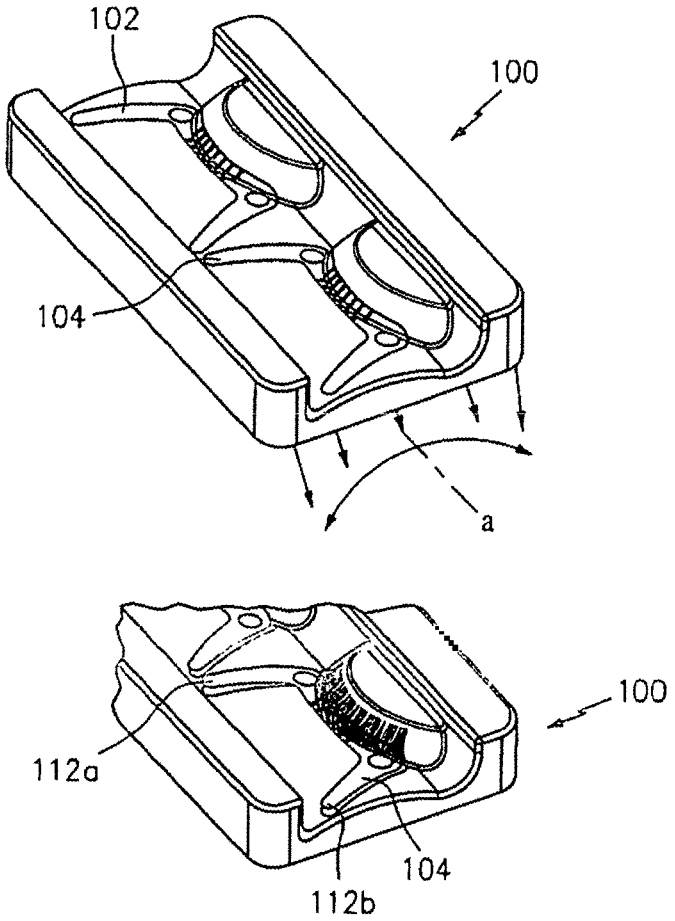
FIG. 4 is a series of diagrams illustrating removal of the artificial eyelash applicator from the packaging tray, according to an embodiment of the present disclosure.
Figure 5:
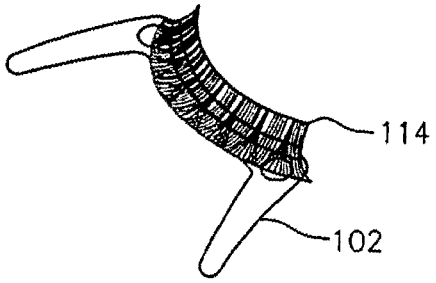
FIG. 5 is a diagram illustrating the artificial eyelash applicator removed from the packaging tray, according to an embodiment of the present disclosure.

Referring now to FIG. 4, a series of diagrams illustrate removal of the first and second artificial eyelash applicators 102 and 104 from the packaging tray 100, according to an embodiment of the present disclosure. As described above, the first and second artificial eyelash applicators 102 and 104 lie in-line with the contours of the top surface of the packaging tray 100 when integrated with packaging tray 100. When it is desired to remove the first and second artificial eyelash applicators 102 and 104, a portion of the first and second artificial eyelash applicators must extend out from the packaging tray 100 so that the user is able to grip a portion of the first and second artificial eyelash applicators 102 and 104 for removal. Thus, the user preferably bends the packaging tray 100 along an axis 'a' that runs parallel with lengths of the first and second main bodies 106 and 110, thereby causing the corresponding legs 108*a*, 108*b*, 112*a* and 112*b* to extend outwardly at an angle from the top surface of the packaging tray 100. This allows the user to grip the corresponding legs 108*a*, 108*b*, 112*a* and 112*b* and break the four connection points 122*a*-122*d* when force is applied, removing the first and second artificial eyelash applicators 102 and 104 from the packaging tray 100. An independent artificial eyelash applicator with an adhered artificial eyelash after removal from the packaging tray 100 is illustrated in FIG. 5, according to an embodiment of the present disclosure. FIG. 5 represents both the first artificial eyelash applicator 102 with the first artificial eyelash 114 and the second artificial eyelash applicator 104 with the second artificial eyelash 116.

Figure 6:
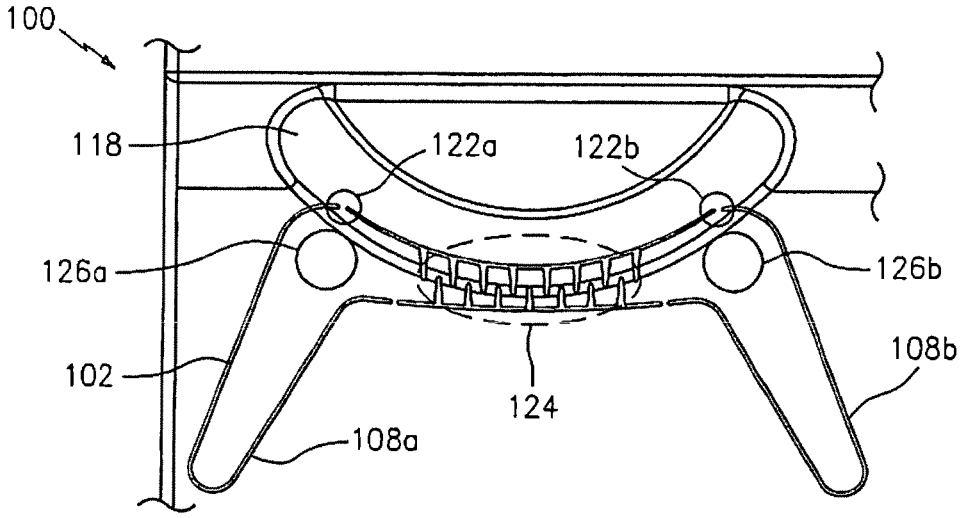
FIG. 6 is a diagram illustrating an artificial eyelash applicator integrated with the packaging tray, according to another embodiment of the present disclosure.

FIG. 6 is a diagram illustrating the first artificial eyelash applicator 102 integrated with the packaging tray 100, according to another embodiment of the present disclosure. Specifically, FIG. 6 only differs from FIG. 3 in the number of attachment points integrating the first artificial eyelash applicator 102 with the packaging tray 100. Accordingly, a detailed description of the elements of FIG. 6 can be found above with reference to FIG. 3. The second eyelash applicator 104 has a configuration that is substantially identical to that described herein with respect to FIG. 6.

In accordance with the embodiment of the present disclosure illustrated in FIG. 6, the first artificial eyelash applicator 102 is only connected to the packaging tray 100 at attachment points 122*a* and 122*b*. Accordingly, less force is required to remove the first artificial eyelash applicator 102 from the packaging tray 100. Further, the first artificial eyelash applicator 102 does not lie in-line with the contours of the packaging tray 100 when integrated with the packaging tray 100. While this embodiment of the present disclosure illustrates two attachment points 122*a* and 122*b*, any number of connection points may be utilised that maintain the artificial eyelash applicator 102 in the proper position with respect to this embodiment, and also allow for removal of the artificial eyelash applicator 102 from the packaging tray 100.

Figure 7:
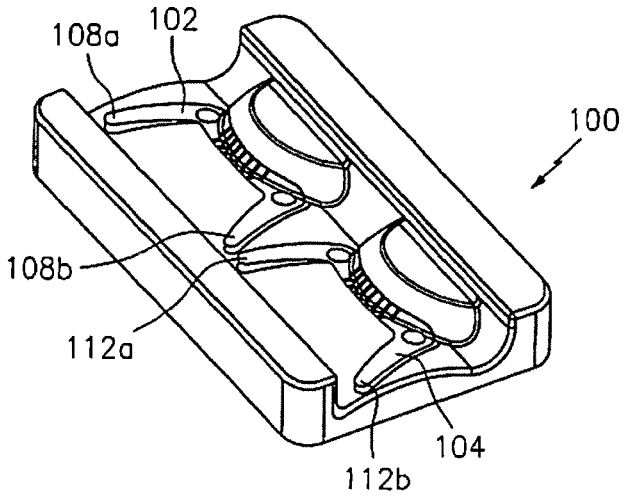
FIG. 7 is a diagram illustrating a perspective view of the packaging tray for artificial eyelashes, according to the embodiment of the present disclosure illustrated in FIG. 6.

Referring now to FIG. 7, a diagram illustrates a perspective view of the packaging tray 100 for artificial eyelashes, according to the embodiment of the present disclosure illustrated in FIG. 6. Specifically, FIG. 7 clearly illustrates that the first and second artificial eyelash applicators 102 and 104 do not lie in-line with the contours of the packaging tray 100 when only two attachment points 122*a* and 122*b* are provided. Instead the corresponding legs 108*a*, 108*b*, 112*a* and 112*b* project outwardly at an angle from the top surface of the packaging tray 100. In a preferred embodiment of the present disclosure, the ends of the corresponding legs 108*a*, 108*b*, 112*a* and 112*b* are approximately 3-6 millimeters (mm) away from the top surface of the packaging tray.

Accordingly, in the embodiment of the present disclosure illustrated in FIGS. 6 and 7, the packaging tray 100 does not need to be bent in order for the corresponding legs 108*a*, 108*b*, 112*a* and 112*b* to project outwardly, and easier access is provided to the user.

Although the first and second artificial eyelash applicators 102 and 104 are disposed differently in FIGS. 6 and 7, the artificial eyelashes 114 and 116 are disposed in the same manner and at the same angle as described above with respect to FIG. 2. Further, when the first and second artificial eyelash applicators 102 and 104 are removed from the packaging tray 100 in the embodiment of FIGS. 6 and 7, they are still embodied as described above with respect to FIG. 5.

Figure 8:
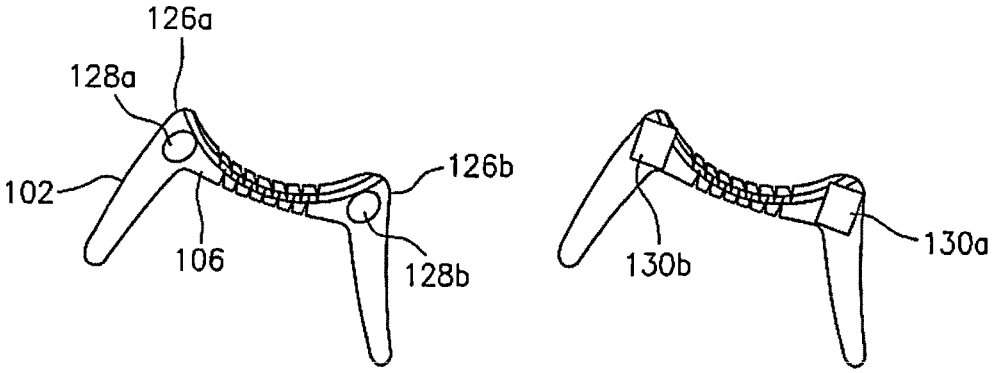
FIG. 8 provides diagrams illustrating top and bottom surfaces of the artificial eyelash applicator, according to an embodiment of the present disclosure.

Referring now to FIG. 8, diagrams illustrate top and bottom surfaces of the artificial eyelash applicator, according to an embodiment of the present disclosure. As described above with respect to FIG. 3, in order to adhere the first artificial eyelash 114 to the first artificial eyelash applicator 102, adhesive may be applied to a top surface of the first main body 106 in the first and second corner regions 126*a* and 126*b*, or adhesive may be applied from a bottom surface of the main body 106 through apertures in the first and second corner regions 126*a* and 126*b*. The embodiment of the present disclosure shown in FIG. 8 illustrates first and second apertures 128*a* and 128*b* in the first and second corner regions 126*a* and 126*b*. Adhesive surfaces 130*a* and 130*b*, such as tape, is applied to the bottom surface of the first artificial eyelash applicator 102 over the first and second apertures 128*a* and 128*b*. Thus, the adhesive is accessed from the top surface of the main body 106 of the first artificial eyelash applicator 102 through each of the first and second apertures 128*a* and 128*b* for application of the first artificial eyelash 114. The second eyelash applicator 104 may have a configuration that is substantially identical to that described herein with respect to FIG. 8.

Figure 9:
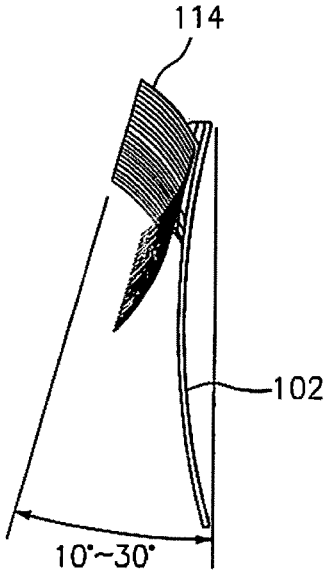
FIG. 9 is a diagram illustrating a side view of the artificial eyelash applicator, according to an embodiment of the present disclosure.

FIG. 9 is a diagram illustrating a side view of the first artificial eyelash applicator 102, according to an embodiment of the present disclosure. The first artificial eyelash 114 is disposed on and adhered to the first artificial eyelash applicator 102 in a manner that allows for easy application. Specifically, the first artificial eyelash 114 is disposed such that hands, fingers and the first artificial eyelash applicator 102, which are proximate to the user's eye during application, do not obstruct the user's view in a mirror when placing the first artificial eyelash 114 on the user's eyelid. A line extending through the length of the base of the first artificial eyelash 114 is preferably at an angle of approximately 10-30 degrees from a vertical line of the top surface of the packaging tray 100 or the first artificial eyelash applicator 102, in this embodiment of the present disclosure. This angle allows for proper sight lines during application of the first artificial eyelash 114. The second eyelash applicator 104 has a configuration that is substantially identical to that described herein with respect to FIG. 9.

Figure 10:
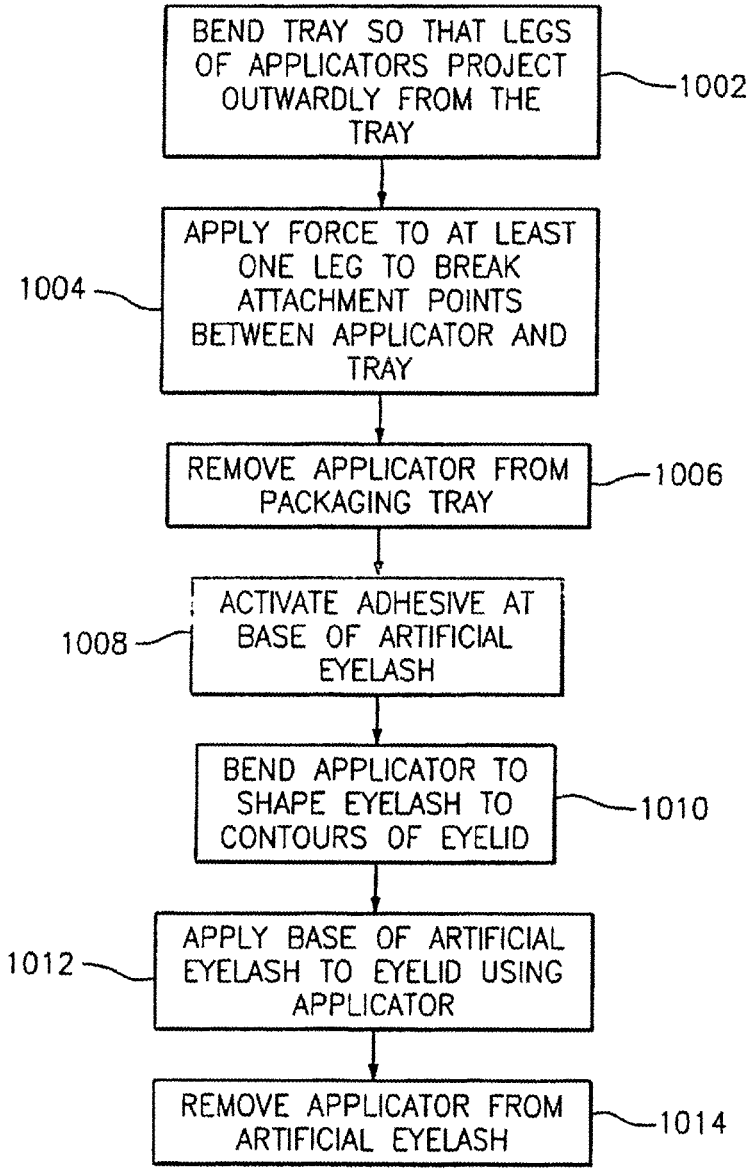
FIG. 10 is a flow diagram illustrating an artificial eyelash application methodology, according to an embodiment of the present disclosure.

Referring now to FIG. 10, a flow diagram illustrates an artificial eyelash application methodology, according to an embodiment of the present disclosure. The methodology begins in at block 1002 when the packaging tray 100 is bent by a user so that the corresponding legs 108*a*, 108*b*, 112*a* and 112*b* of the first and second artificial eyelash applicators 102 and 104 are moved so that they are no longer in-line with contours of the top surface of the packaging tray 100. Instead, the corresponding legs 108*a*, 108*b*, 112*a* and 112*b* now project outwardly at an angle from the top surface of the packaging tray 100. As described above with respect to FIGS. 6 and 7, block 1002 may be skipped in the methodology, when the first and second artificial eyelash applicators 102 and 104 are connected to the packaging tray 100 at fewer attachment points.

In block 1004, a force is applied to at least one leg of one of the first and second artificial eyelash applicators 102 and 104, such that the attachment points between the artificial eyelash applicator and the packaging tray 100 break. In block 1006, the artificial eyelash applicator is removed from the packaging tray. The artificial eyelash remains disposed on and adhered to the artificial eyelash applicator.

In order to apply the artificial eyelash, an adhesive at the base of the artificial eyelash is activated, by moisture for example, in block 1008. The user then bends the artificial eyelash applicator to shape the artificial eyelash to the contours of the user's eyelid, in block 1010, and applies the base of the artificial eyelash to the user's eyelid using the artificial eyelash applicator, in block 1012. As described above with respect to FIG. 9, the artificial eyelash is disposed on the applicator such that hands, fingers and the applicator itself do not obstruct the user's view in a mirror when placing the artificial eyelash on the user's eyelid.

When adhered to the user's eyelid, the artificial eyelash applicator is removed from the artificial eyelash, in block 1014. The artificial eyelash applicator is able to be removed because it has a weaker adhesive than that between the artificial eyelash and the user's eyelid.

Figure 11A:
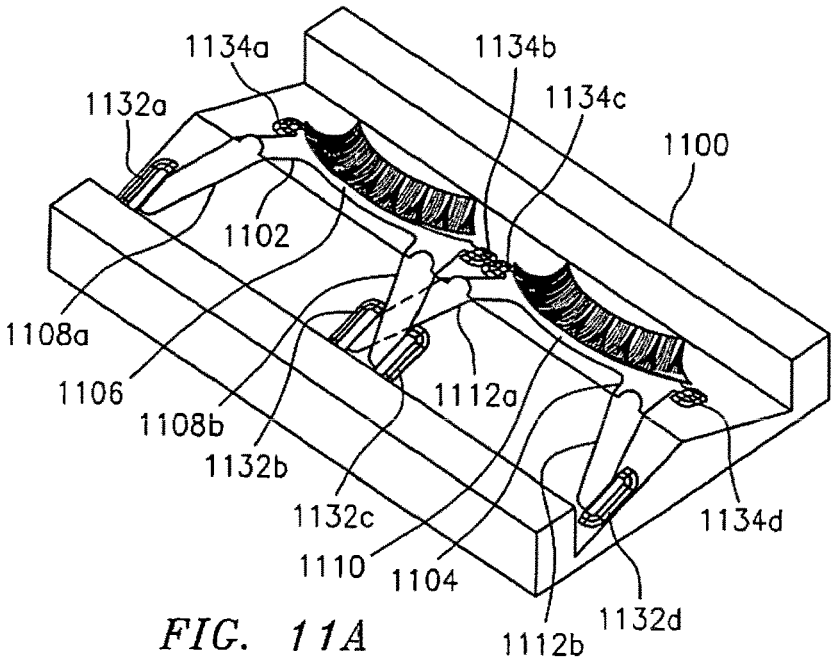
FIGS. 11A and 11B are diagrams illustrating perspective views of an artificial eyelash applicator integrated with a packaging tray, according to an embodiment of the present disclosure.
Figure 11B:
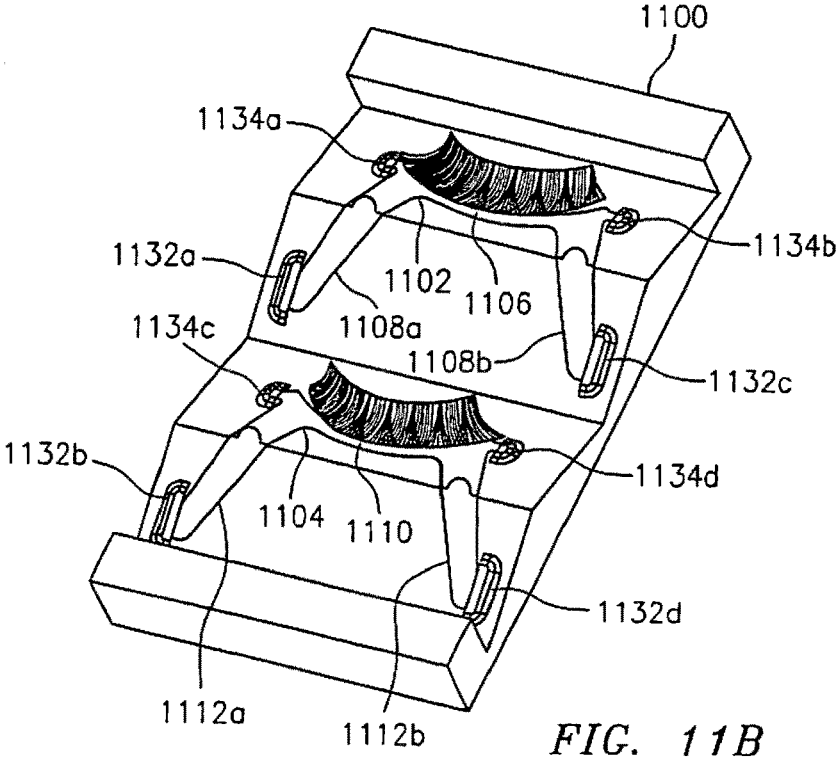

Referring now to FIGS. 11A and 11B, diagrams illustrate perspective views of an artificial eyelash applicator integrated with a packaging tray, according to an embodiment of the present disclosure. FIG. 11A illustrates artificial eyelash applicators arranged side by side, while FIG. 11B illustrates artificial eyelash applicators arranged above and below each other. A packaging tray 1100, a first artificial eyelash applicator 1102, and a second artificial eyelash applicator 1104 have substantially the same shape as the corresponding components described with respect to FIGS. 1-9. However, the packaging tray 1100 also includes a plurality of primary receiving slits 1132*a*-1132*d*. Each of the plurality of primary receiving slits 1132*a*-1132*d* receives a corresponding end of legs 1108*a*, 1108*b*, 1112*a* and 1112*b* of the first and second artificial eyelash applicators 1102 and 1104. Specifically, a first primary receiving slit 1132*a* receives an end of a first leg 1108*a* of the first artificial eyelash applicator 1102. A second primary receiving slit 1132*b* receives an end of a first leg 1112*a* of the second artificial eyelash applicator 1104. A third primary receiving slit 1132*c* receives an end of a second leg 1108*b* of the first eyelash applicator 1102. A fourth primary receiving slit 1132*d* receives an end of a second leg 1112*b* of the second eyelash applicator 1104.

The packaging tray 1100 of FIG. 11 also includes a plurality of secondary receiving slits 1134*a*-1134*d*. Each of the plurality of secondary receiving slits 1134*a*-1134*d* receives an extension from a corresponding end of first and second main bodies 1106 and 1110 of the first and second artificial eyelash applicators 1102 and 1104. Specifically, a first secondary receiving slit 1134*a* receives an extension from first end of a first main body 1106 of the first artificial eyelash applicator 1102. A second secondary receiving slit 1134*b* receives an extension from a second opposing end of the first main body 1106 of the first artificial eyelash applicator 1102. A third secondary receiving slit 1134*c* receives an extension from a first end of the second main body 1110 of the second artificial eyelash applicator 1104. A fourth secondary receiving slit 1134*d* receives an extension from a second opposing end of the second main body 1110 of the second artificial eyelash applicator 1104. The primary and secondary receiving slits 1132*a*-1134*d* assist in maintaining the first and second artificial eyelash applicators 1102 and 1104 in the packaging tray 1100. The embodiments of the present disclosure are not limited to this number and configuration of receiving slits. Specifically, any number and configuration of receiving slits may be used that achieve the object of maintaining the artificial eyelash applicators in the packaging tray.

Figure 12B:
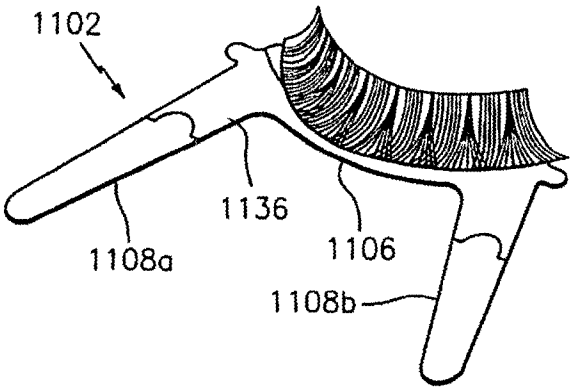
FIGS. 12A and 12B are diagrams illustrating perspective views of the artificial eyelash applicator of FIG. 11, according to an embodiment of the present disclosure.
Figure 12A:
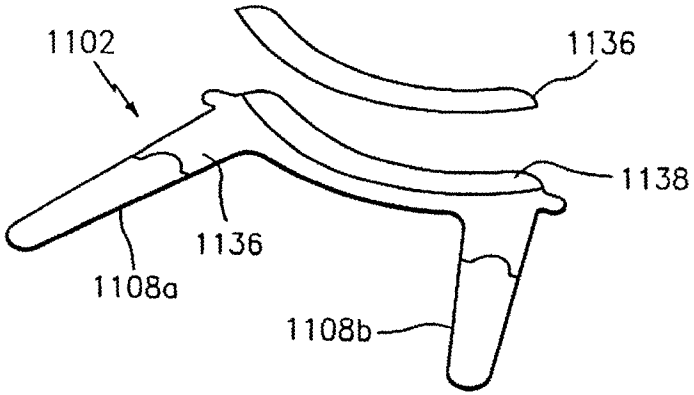

Referring now to FIGS. 12A and 12B, diagrams illustrate perspective views of the artificial eyelash applicator of FIGS. 11A and 11B, according to an embodiment of the present disclosure. FIG. 12A shows the first artificial eyelash applicator 1102 having a cover layer 1136 that is disposed on top of an adhesive layer 1138. The cover layer 1136 is precut in an area on each of the first leg 1108*a* and the second leg 1108*b*, which allows for removal of the cover layer 1136 to expose the adhesive layer 1138 beneath. This removal is described in further detail below with respect to FIGS. 13A and 13B. The cover layer 1136 covers a portion of the first main body 1106. A remaining portion of the first main body 1106 has the adhesive layer 1138 exposed. The adhesive layer 1138 is exposed on this remaining portion of the first main body 1106 for attachment of the artificial eyelash, as illustrated in FIG. 12B.

Figure 13B:
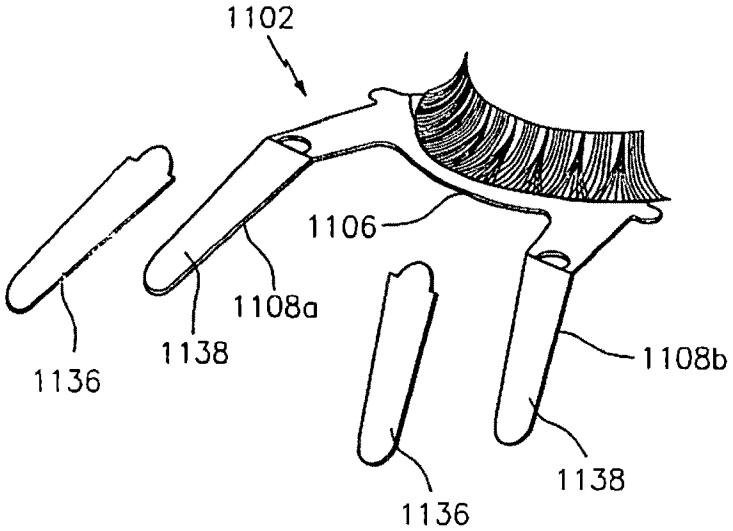
FIGS. 13A and 13B are diagrams illustrating removal of a cover layer from an adhesive layer of the artificial eyelash applicator, according to an embodiment of the present disclosure.
Figure 13A:
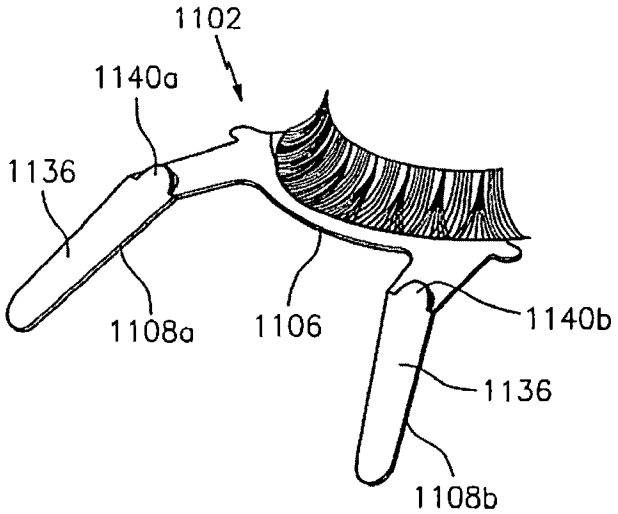

FIGS. 13A and 13B are diagrams illustrating removal of a cover layer from an adhesive layer of the artificial eyelash applicator of FIG. 11, according to an embodiment of the present disclosure. Specifically, as shown in FIG. 13A, the first and second legs 1108*a* and 1108*b* are bent such that tabs 1140*a* and 1140*b* are exposed. The tabs 1140*a* and 1140*b* are precut in the cover layer 1136 in a midsection of each of the first and second legs 1108*a* and 1108*b*. The cover layer 1136 is then peeled away from the adhesive layer 1138 using the tabs 1140*a* and 1140*b*, exposing the adhesive layer 1138 on the lower half of each of the first and second legs 1108*a* and 1108*b*. The adhesive layer 1138 allows for easier control of the artificial eyelash applicator during application. Specifically, the adhesive layer 1138 adheres to the fingers of a user during application of the artificial eyelash. The second artificial eyelash applicator 1104 may be embodied in a manner substantially identical to that described above in FIGS. 12A-13B with respect to the first artificial eyelash applicator 1104. The embodiments of the present disclosure are not limited to the positioning and shape of the precut lines and the removed portions of the cover layer on the first and second legs illustrated in FIGS. 13A and 13B. Further, the embodiments of the present disclosure are not limited to the shape, size or number of exposed adhesive portions on the main body as illustrated in FIGS. 13A and 13B. Specifically, any shape, configuration or number of exposed portions of adhesive layer may be used that achieve the object of the present disclosure.

The embodiment of the present disclosure illustrated in FIGS. 11A-13B may include a packaging tray constructed of a lightweight material, such as, for example, paper or cardboard. Further, the artificial eyelash applicators in this embodiment of the present disclosure may also be constructed of a lightweight material that includes a paper layer with an adhesive and a wax paper cover layer that covers the adhesive of the paper layer.

Figure 14A:
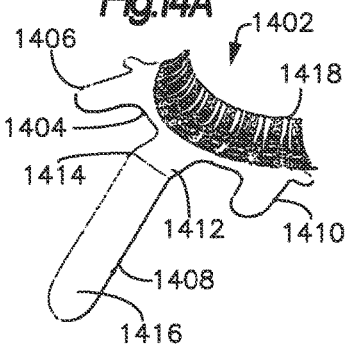
FIG. 14A is a diagram illustrating a perspective view of an artificial eyelash applicator, according to an embodiment of the present disclosure.

Referring to FIG. 14A, a diagram illustrates a perspective view of an artificial eyelash applicator, according to an embodiment of the present disclosure. An applicator 1402 has a main body 1404, a left side leg 1406, a center leg 1408, and a right side leg 1410. The left side leg 1406 extends from a left end of a length of the main body 1404, and the right side leg 1410 extends from a right end of the length of the main body 1404. The center leg 1408 extends from a central region along the length of the main body 1404. The main body 1404 has a generally curved length, which mimics the curvature of a user's eyelid. Each of the left side leg 1406, the center leg 1408, and the right side leg 1410 extend in a direction that is substantially perpendicular to tangents of respective connecting points along the curved length of the main body 1404. This causes a general wishbone shape for the main body 1404, the left side leg 1406 and the right side leg 1410.

The left side leg 1406 and the right side leg 1410 extend from the main body 1404 in the same plane as the main body 1404. The center leg 1408 has a first segment 1412 that extends away from the main body 1404 in the same plane as the main body 1404 up to a specified line 1414, after which a second segment 1416 of the center leg 1408 extends away from the main body 1404 at a downward angle. The second segment 1416 of the center leg extends downwardly away from the plane of the main body 1404 at an angle between 30-60 degrees, and preferably approximately 45 degrees.

An artificial eyelash 1418 is disposed on, and temporarily adhered to, the main body 1404 of the artificial eyelash applicator 1402. The artificial eyelash 1418 may be temporarily adhered to the main body 1404 using an adhesive disposed at least partially along a length of the main body. More specifically, the adhesive is disposed along a length of a side of the main body 1404 that opposes a side of the main body 1404 from which the left side leg 1406, the center leg 1408, and the right side leg 1410 extend. Adhesive may also be applied to one or more specific regions on the above-described side of the main body 1404. For example, adhesive may be applied in corner regions of the main body 1404. In alternate embodiments of the present disclosure, adhesive may be applied from a bottom surface of the main body 1404 through apertures at the one or more specified regions of the main body 1404, as described above.

The left side leg 1406 and the right side leg 1410 may be grasped by the user to properly position the artificial eyelash applicator 1402 and the artificial eyelash 1418 over an eyelid of the user for application of the artificial eyelash 1418 on the eyelid of the user. Due to the above-described substantially wishbone shape of the left side leg 1406, the right side leg 1410, and the main body 1404, the left side leg 1406 and the right side leg 1410 are angled away from each other. This shape prevents a user's hand from interfering with the vision of the user, when the artificial eyelash applicator 1402 is being used to apply the artificial eyelash 1418 on the eyelid of the user. The center leg 1408 is disposed such that it is allows a user to properly position an artificial eyelash in the center of the users' eyeline. More specifically, the center leg 1408 is angled downwardly so that it obstructs the eyeline of the user, when the artificial eyelash applicator 1402 is centered on the user's eyelid. This can make proper application easier when a mirror is not available to ensure that the artificial eyelash 1412 is centered. The center leg 1408 may also be grasped by the user for application of the artificial eyelash 1418.

The artificial eyelash 1418 is disposed on and adhered to the artificial eyelash applicator 1402 in a manner that allows for easy application. Specifically, the artificial eyelash 1412 is disposed such that hands, fingers, the main body 1404, the left side leg 1406, and the right side leg 1410, which are proximate to the user's eye during application, do not obstruct the user's view in a mirror when placing the artificial eyelash 1418 on the user's eyelid.

Figure 14B:
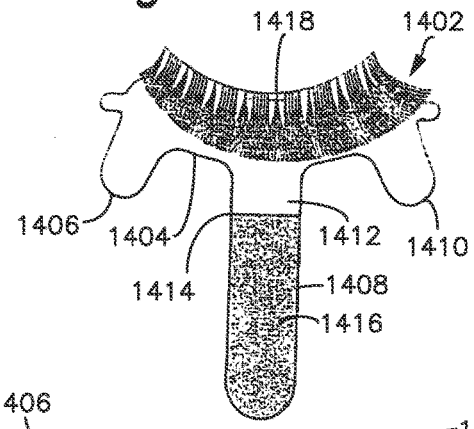
FIG. 14B is a diagram illustrating a top view of the artificial eyelash applicator, according to the embodiment of the present disclosure illustrated in FIG. 14A.
Figure 14D:
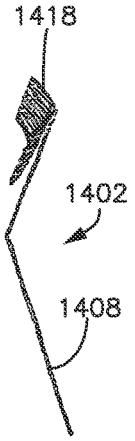
FIG. 14D is a diagram illustrating a side view of the artificial eyelash applicator, according to the embodiment of the present disclosure illustrated in FIG. 14A.
Figure 14C:
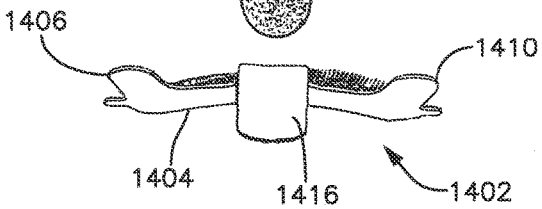
FIG. 14C is a diagram illustrating a front view of the artificial eyelash applicator, according to the embodiment of the present disclosure illustrated in FIG. 14A.

FIG. 14B is a diagram illustrating a top view of the artificial eyelash applicator, according to the embodiment of the present disclosure illustrated in FIG. 14A. FIG. 14C is a diagram illustrating a front view of the artificial eyelash applicator, according to the embodiment of the present disclosure illustrated in FIG. 14A. FIG. 14D is a diagram illustrating a side view of the artificial eyelash applicator, according to the embodiment of the present disclosure illustrated in FIG. 14A.

Figure 15A:
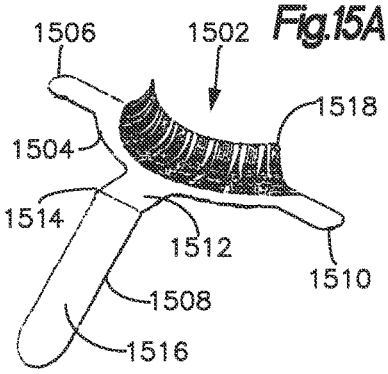
FIG. 15A is a diagram illustrating a perspective view of an artificial eyelash applicator, according to another embodiment of the present disclosure.

Referring now to FIG. 15A, a diagram illustrates a perspective view of an artificial eyelash applicator, according to another embodiment of the present disclosure. An applicator 1502 has a main body 1504, a left side leg 1506, a center leg 1508, and a right side leg 1510. The left side leg 1506 extends from a left end of a length of the main body 1504, and the right side leg 1510 extends from a right end of the length of the main body 1504. The center leg 1508 extends from a central region along the length of the main body 1504. The main body 1504 has a generally curved length, which mimics the curvature of a user's eyelid. The center leg 1508 extends in a direction that is substantially perpendicular to a tangent of a connecting point along the curved length of the main body 1504.

The left side leg 1506 and the right side leg 1510 extend from the main body 1504 in opposite directions, which are both perpendicular to the center leg 1508, while remaining in the same plane as the main body 1504. The center leg 1508 has a first segment 1512 that extends away from the main body 1504 in the same plane as the main body 1504 up to a specified line 1514, after which a second segment 1516 of the center leg 1508 extends away from the main body 1504 at a downward angle. The second segment 1516 of the center leg extends downwardly away from the plane of the main body 1504 at an angle between 30-60 degrees, and preferably approximately 45 degrees.

An artificial eyelash 1518 is disposed on, and temporarily adhered to, the main body 1504 of the artificial eyelash applicator 1502. The artificial eyelash 1518 may be temporarily adhered to the main body 1504 using the techniques described above with respect to FIG. 14A.

The left side leg 1506 and the right side leg 1510 may be grasped by the user to properly position the artificial eyelash applicator 1502 and the artificial eyelash 1518 over an eyelid of the user for application of the artificial eyelash 1512 on the eyelid of the user. Due to the above-described opposing directions of the left side leg 1506 and the right side leg 1510, a user's hand is prevented from interfering with the vision of the user, when the artificial eyelash applicator 1502 is being used to apply the artificial eyelash 1518 on an eyelid of the user. The center leg 1508 is disposed such that it allows a user to properly position an artificial eyelash in the center of the users' eyeline, as described above with respect to FIG. 14A. The artificial eyelash 1518 is disposed on and adhered to the artificial eyelash applicator 1502 in a manner that allows for easy application, as described above with respect to FIG. 14A.

Figure 15B:
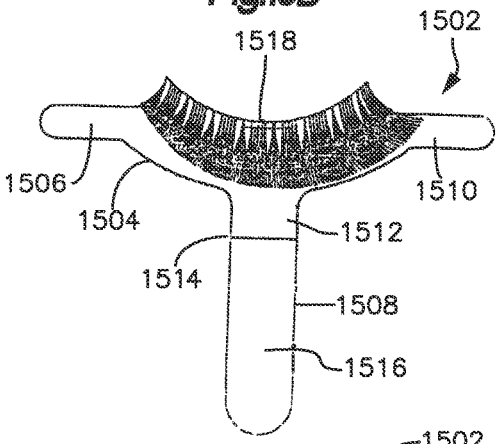
FIG. 15B is a diagram illustrating a top view of the artificial eyelash applicator, according to the embodiment of the present disclosure illustrated in FIG. 15A.
Figure 15D:
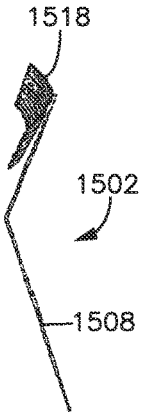
FIG. 15D is a diagram illustrating a side view of the artificial eyelash applicator, according to the embodiment of the present disclosure illustrated in FIG. 15A.
Figure 15C:
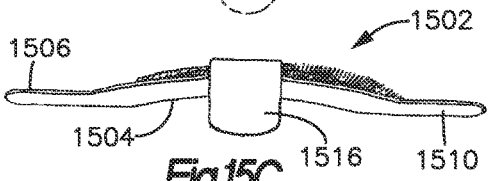
FIG. 15C is a diagram illustrating a front view of the artificial eyelash applicator, according to the embodiment of the present disclosure illustrated in FIG. 15A.

FIG. 15B is a diagram illustrating top view of the artificial eyelash applicator, according to the embodiment of the present disclosure illustrated in FIG. 15A. FIG. 15C is a diagram illustrating a front view of the artificial eyelash applicator, according to the embodiment of the present disclosure illustrated in FIG. 15A. FIG. 15D is a diagram illustrating a side view of the artificial eyelash applicator, according to the embodiment of the present disclosure illustrated in FIG. 15A.

Figure 16:
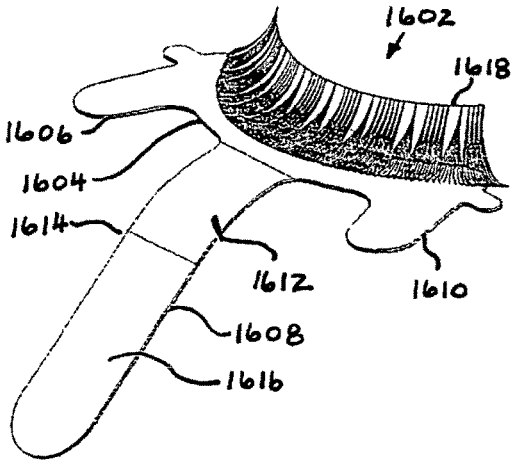
FIG. 16 is a diagram illustrating a perspective view of an artificial eyelash applicator having a curved middle leg, according to an embodiment of the present disclosure.

Referring now to FIG. 16, a diagram illustrates a perspective view of an artificial eyelash applicator having a curved middle leg, according to an embodiment of the present disclosure. An artificial eyelash applicator 1602 is shown having a main body 1604, a left side leg 1606, a center leg 1608, and a right side leg 1610. The main body 1604, the left side leg 1606, and the right side leg 1610 are constructed in a manner similar to that described above with respect to FIG. 14A. An artificial eyelash 1618 is disposed on the main body 1604 of the artificial eyelash applicator 1602.

The center leg 1608 extends away from the main body 1604 in a same direction as shown in FIGS. 14A and 15A. However, the center leg 1608 has a first segment 1612 that curves downwardly away from a plane of the main body 1604, instead of extending a specified distance in the plane of the main body, as described above with respect to FIG. 15A.

The first segment 1612 of the center leg 1608 transitions into a second segment 1616 of the center leg 1608, which is straight, at a specified line 1614. The second segment 1616 is disposed at a specified angle with respect to the plane of the main body 1604. Specifically, the second segment 1616 is disposed at an angle between 30 and 60 degrees with respect to the plane of the main body 1604, and preferably, approximately 45 degrees.

Figure 17:
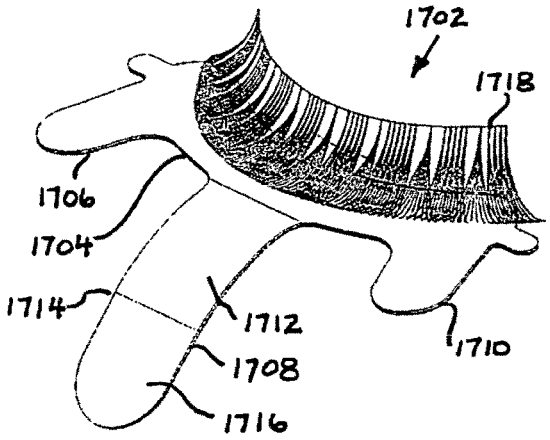
FIG. 17 is a diagram illustrating a perspective view of an artificial eyelash applicator having a shorter curved middle leg, according to an embodiment of the present disclosure.

FIG. 17 is a diagram illustrating a perspective view of an artificial eyelash applicator having a shorter curved middle leg, according to an embodiment of the present disclosure. An artificial eyelash applicator 1702 having a main body 1704, a left side leg 1706, a center leg 1708, and a right side leg 1710 are constructed in a manner similar to that described above with respect to FIG. 16. An artificial eyelash 1718 is disposed on the main body 1704 of the artificial eyelash applicator 1702. While a first segment 1712 of the center leg 1708 is also constructed in a manner similar to that described above with respect to FIG. 16. The first segment 1712 transitions to a second segment 1716 of the center leg 1708, which is significantly shorter than the second segment 1616 of the center leg 1608 of FIG. 16, at a specified line 1714.

Figure 18:
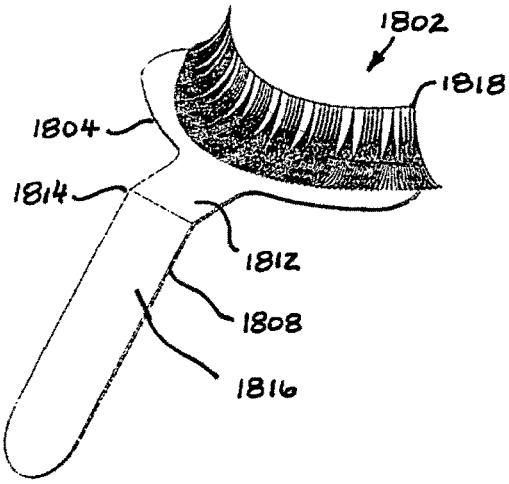
FIG. 18 is a diagram illustrating a perspective view of an artificial eyelash applicator having only a middle leg, according to an embodiment of the present disclosure.

FIG. 18 is a diagram illustrating a perspective view of an artificial eyelash applicator having only a center leg, according to an embodiment of the present disclosure. An artificial eyelash applicator 1802 having a main body 1804 and a center leg 1808 is constructed in a manner similar to that described above with respect to FIG. 14A. Specifically, a first segment 1812, a specified line 1814, and a second segment 1816 are similar to respective components of FIG. 14A. However, the eyelash applicator is constructed without a left side leg and a right side leg. Thus, an artificial eyelash 1818 is applied to a users' eyelid by grasping only the center leg 1808 of the artificial eyelash applicator 1802. Alternate embodiments of the present disclosure may include an artificial eyelash applicator having a main body, a center leg, and one of a right and left side leg.

FIGS. 19 to 23 illustrate the applicator 1902 for artificial eyelashes according to another embodiment of the disclosure. The following description focuses primarily upon the structure and features that are different than the embodiment described above in connection with FIGS. 1 to 18. Reference should be made to the description above in connection with FIGS. 1 to 18 for additional information regarding the structure and features, and possible alternatives to the structure and features of the applicator 1902 illustrated in FIGS. 19 to 23 and described below. Structure and features of the embodiment shown in FIGS. 19 to 23 that correspond to structure and features of the embodiment of FIGS. 1 to 18 are designated hereinafter with like reference numbers.

The applicator 1902 in this embodiment includes a first leg 1904, and a second leg 1906 rotatably coupled to the first leg 1904 at a hinge joint 1908. The hinge joint 1908 defines a rotational axis 1910. In the illustrated embodiment, the first and second legs 1904, 1906 are integrally formed as one piece, and the hinge joint 1908 is a crease, i.e., thinner in cross section relative to adjacent portions of the first and second legs 1904, 1906. In other embodiments, the first and second legs 1904, 1906 may be formed separately, and the hinge joint 1908 may include one or more female and male members, and corresponding coupling members that may be insertable through the female and male members to couple the first and second legs 1904, 1906 together. The applicator 1902 may be composed of a lightweight material such as paper, cardboard, or thin plastic. It should be appreciated that in various other embodiments, the hinge joint 1908 is defined by any other suitable type of hinge which is comprised of the same or different material as the first leg 1904 and the second leg 1906. For instance, in various embodiments, the hinge joint 1908 is defined by a thin plastic hinge to which the first leg 1904 and second leg 1906 are attached by adhesive or other suitable attachment means.

Figure 19:
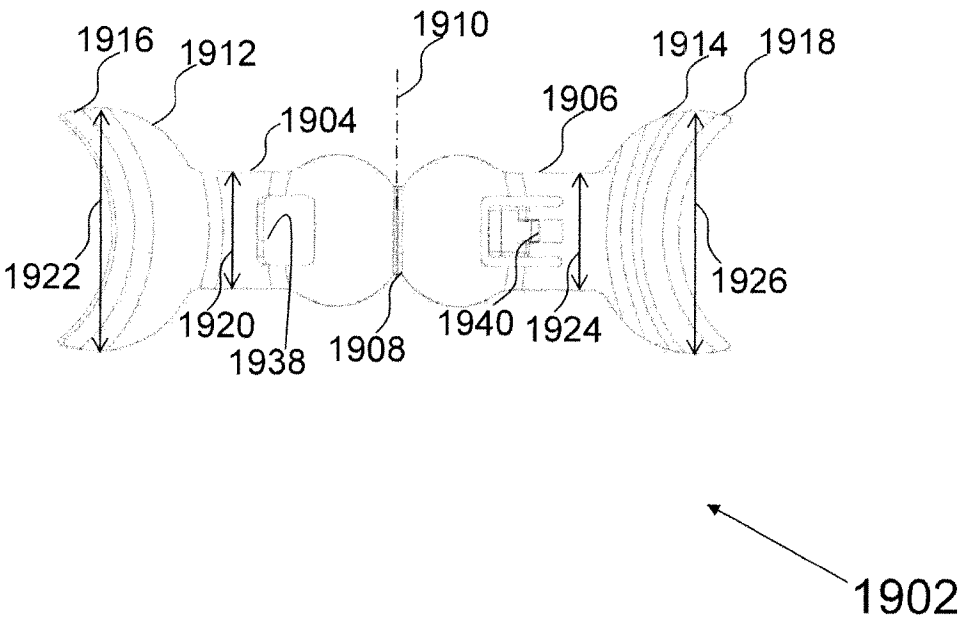
FIG. 19 is a plan view of an applicator for artificial eyelashes according to another embodiment of the present disclosure.
Figure 20:
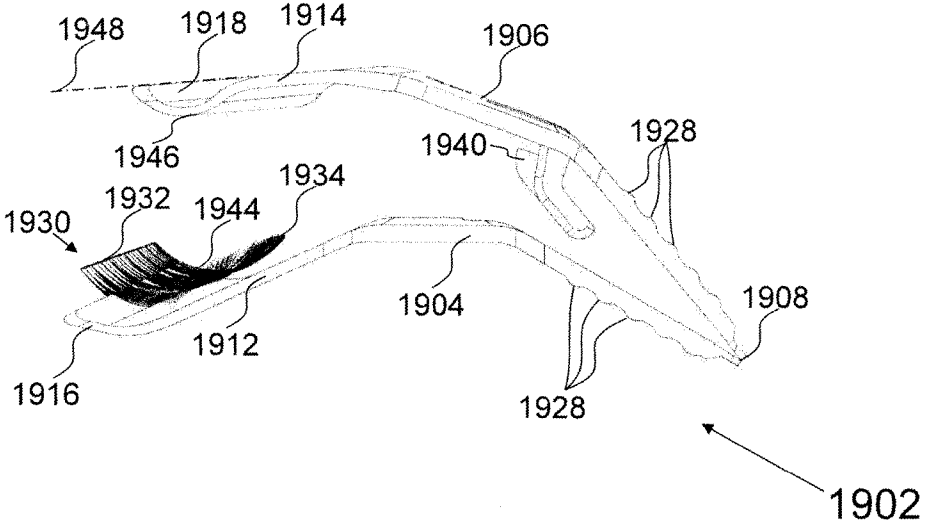
FIG. 20 is a side view of the applicator shown in FIG. 19, illustrating a set of artificial eyelashes disposed thereon.

A first body portion 1912 is connected to the first leg 1904, and a second body portion 1914 is connected to the second leg 1906. The first body portion 1912 includes a first flange 1916 positioned opposite the hinge joint 1908, and the second body portion 1914 includes a second flange 1918 positioned opposite the hinge joint 1908. The first flange 1916 matingly receives the second flange 1918 when the second leg 1906 is rotated toward the first leg 1904 about the rotation axis 1910. Referring to FIG. 19, the first and second flanges 1916, 1918 each define a concave arc lying in a section plane that is coplanar with the rotation axis 1910 of the hinge joint 1908. As such, the first and second body portions 1912, 1914 each have a slight concave curvature, which mimics the curvature of a user's eyelid (not shown).

With continuing reference to FIG. 19, in the illustrated embodiment, the first leg 1904 defines a first portion providing a proximal end of the first leg proximate the hinge joint 1908 and a second portion providing a distal end of the first leg 1904. The second portion of the first leg 1904 defines a first leg width 1920, the first body portion 1912 defines a first body portion width 1922, and the first leg width 1920 is about one third or more of the first body portion width 1922. In further embodiments, the second leg 1906 defines a first portion providing a proximal end of the second leg 1906 proximate the hinge joint 1908 and a second portion providing a distal end of the second leg 1906. The second portion of the second leg 1906 defines a second leg width 1924, the second body portion 1914 defines a second body portion width 1926, and the second leg width 1924 is about one third or more of the second body portion width 1926. In still further embodiments, the first and second leg widths 1920, 1924 are substantially the same. The applicator 1902 can generally have a wishbone shape due to the first and second leg widths 1920, 1924 relative to the first and second body portion widths 1922, 1926, and the curvatures of the first second body portions 1912, 1914. The wishbone shape of the applicator 1902 can further facilitate easily and conveniently applying the artificial eyelashes to a user's eyelid, as detailed above with reference to FIG. 14A.

Referring to FIGS. 20 to 23, a plurality of raised surfaces or ribs 1928 are positioned on the outer surfaces of the first portions of the first and second legs 1904, 1906 adjacent the hinge joint 1908. The raised surfaces 1928 can provide friction for easy gripping or grasping. In other embodiments, the first and second legs 1904, 1906 can include fewer than all the illustrated raised surfaces. In the illustrated embodiment, each raised surface 1928 has the shape of an elongated strip when viewed from above. In other embodiments, however, each raised surface 1928 may assume any geometric form when viewed from above, including, but not limited to, a polygon, an oval, an ellipse, a lens, a squircle, a symbol, or a combination thereof. In various other embodiments, rather than using raised surfaces 1928, first and second legs 1904, 1906 have a rougher texture adjacent hinge joint 1908 than at the area distal from the hinge joint 1908 to provide friction for easy gripping or grasping.

With continuing reference to FIGS. 20 to 23, a set of artificial eyelashes 1930 is disposed on to the first flange 1916. The set of artificial eyelashes 1930 may be temporarily adhered to the first flange 1916 using the techniques described above with reference to FIG. 14A, e.g., using a tape or adhesive having low tackiness. The set of eyelashes 1930 includes a proximal portion 1932 to be applied to the user's eyelid, and a distal portion 1934 to be positioned opposite to the user's eyelid. The proximal portion 1932 may include a pre-applied adhesive to be activated when applying the set of artificial eyelashes 1930 with the applicator 1902, as further explained below.

In prior art configurations, the applicator and eyelashes are typically separated at the point of purchase. The user may then be required to accurately place the eyelashes on the applicator and proceed with the glue work, which can be time-consuming and cumbersome. In contrast to prior art configurations, the set of artificial eyelashes 1930 is fixed or disposed on the first flange 1916 when the applicator 1902 is shipped and/or when the applicator 1902 is at the point of purchase. Therefore, the user can simply grasp the applicator 1902 with the set of artificial eyelashes 1930 disposed thereon, without separately retrieving the artificial eyelashes for placing onto the applicator. As such, the applicator 1902 can make the glue work for applying the set of artificial eyelashes 1930 efficient, user-friendly, and tidy.

Figure 21:
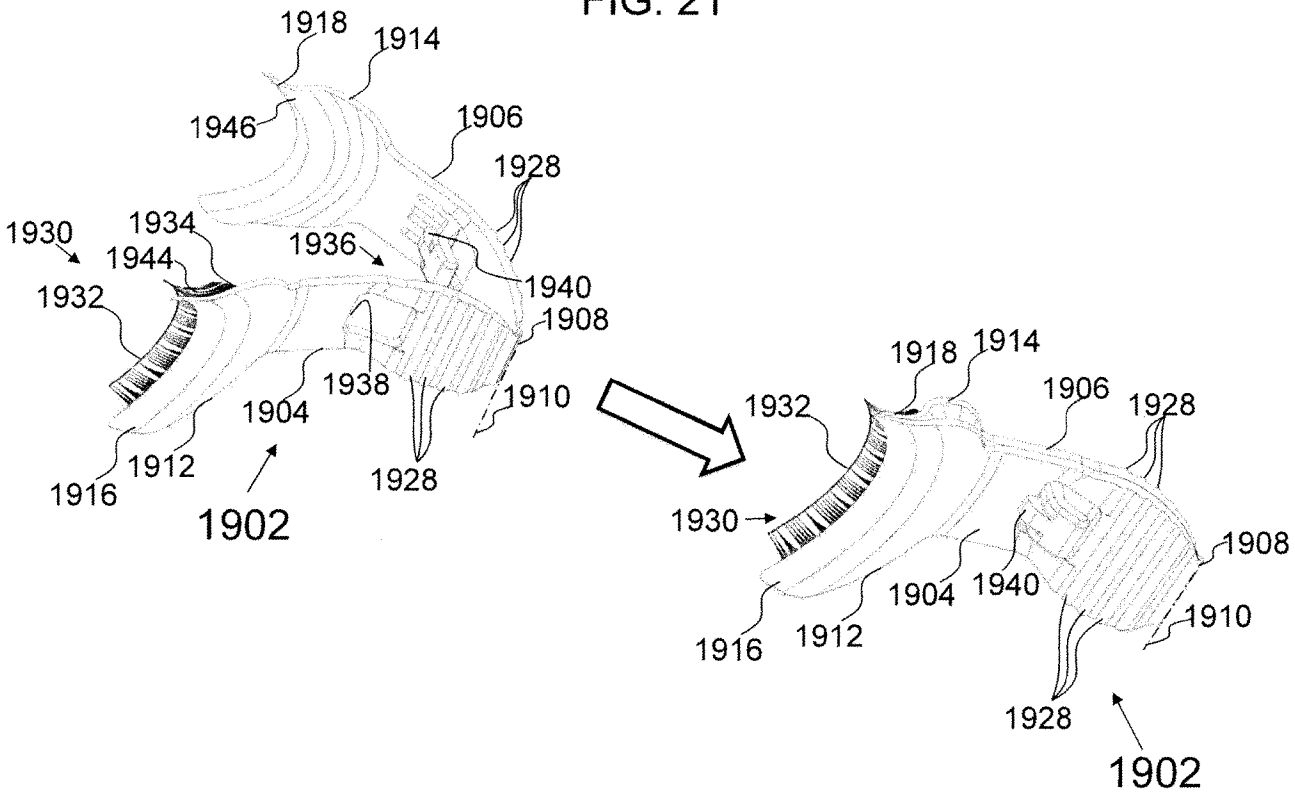
FIG. 21 is a series of bottom perspective views of the applicator shown in FIG. 20, illustrating opened and closed positions.
Figure 22:
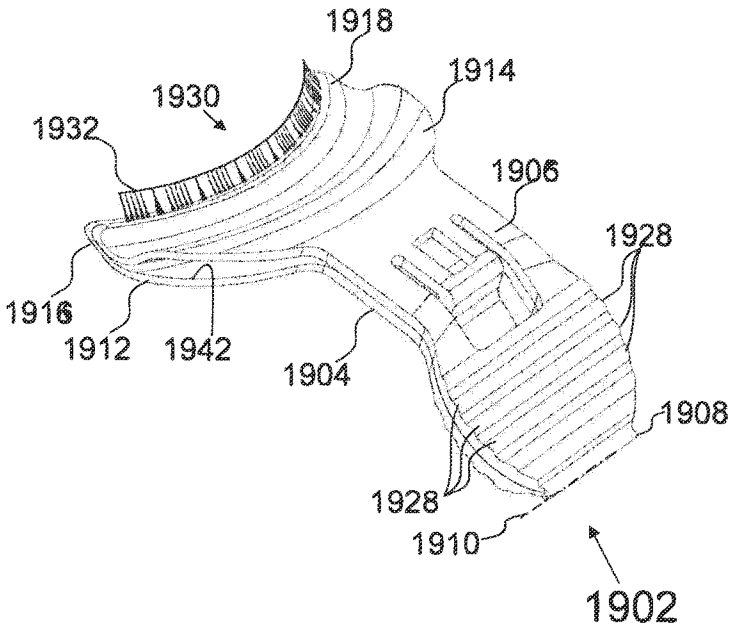
FIG. 22 is a top perspective view of the applicator shown in FIG. 20, illustrating the closed position.

In the illustrated embodiment, the applicator 1902 includes a coupling mechanism 1936 that includes hook 1940 extending from the inner surface of the second leg 1906 toward the first leg 1904 and an opening with a catch mechanism positioned on the first leg 1904, where the opening extends from the inner surface of the first leg 1904 through an entire thickness of the first leg to the outer surface of the first leg 1904. Referring to FIG. 21, the hook 1940 is selectively movable between a locked closed configuration (see bottom right of FIG. 21) where the hook 1940 extends through the opening and contacts the corresponding catch mechanism 1938, and an unlocked open configuration where the hook 1940 is released out of the locking position (see top left of FIG. 21). When the user folds or rotates the second leg 1906 toward the first leg 1904 about the rotational axis 1910, and rotates the hook 1940 toward the catch mechanism 1938, the hook 1940 contacts the catch mechanism 1938 and locks the first and second legs 1904, 1906 together in a closed position. On the other hand, when the user rotates the hook 1940 away from the catch mechanism 1938 (e.g., using a thumb), the hook 1940 is released out of the locking position, thereby enabling the second leg 1906 to rotate upwardly about the rotational axis 1910 toward an opened position. As used herein, the terms "top," "bottom," "side," "upwardly," "downwardly," and other directional terms are not intended to require any particular orientation, but are instead used for purposes of description only.

Although in the illustrated embodiment the coupling mechanism 1936 includes only a single catch mechanism 1938 on the first leg 1904, and only a single hook 1940 on the second leg 1906, in further embodiments, the first leg 1904 may include one or more catch mechanisms 1938, one or more hooks 1940, or a combination thereof. Similarly, the second leg 1906 may include one or more catch mechanisms 1938, one or more hooks 1940, or a combination thereof. As such, the catch mechanism 1938 and the corresponding hook 1940 can be on either of the first and second legs 1904, 1906. Moreover, although FIGS. 19 to 23 illustrate the catch mechanism 1938 and the hook 1940 as integrally formed with the first and second legs 1904, 1906, respectively, in other embodiments the catch mechanism 1938 and the hook 1940 may be separately formed and attached to a respective one of the first and second legs 1904, 1906 via glue or fasteners. In various other embodiments, the coupling mechanism 1936 includes a button, a snap, a hook-and-loop fastener, or other suitable fasteners to releasably lock the first and second legs 1904, 1906 together.

Figure 23:
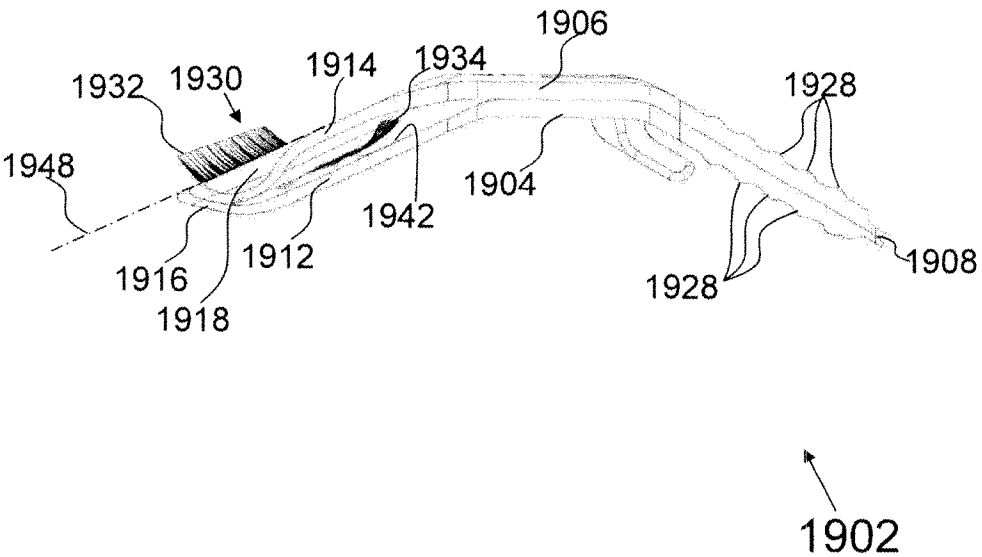
FIG. 23 is a side view of the applicator shown in FIG. 22.

Referring to FIG. 23, when the first and second legs 1904, 1906 are locked together in the closed configuration, the inner surfaces of the first and second legs 1904, 1906 are in abutting contact, a gap 1942 extends between the first and second body portions 1912, 1914, and the set of artificial eyelashes 1930 extends within the gap 1942. In the illustrated embodiment, an intermediate portion 1944 of the set of artificial eyelashes 1930 between the proximal and distal portions 1932, 1934 is held by the first and second flanges 1916, 1918, and the distal portion 1934 of the set of artificial eyelashes 1930 extends into the gap 1942. In this way, the distal portion 1934 of the set of artificial eyelashes 1930 can be protected and maintained in its natural shape. Additionally, the first portions of the first and second legs 1904, 1906 extend vertically upward at an angle from the proximal ends toward the second portions of the first and second legs 1904, 1906, respectively. The second portions of the first and second legs 1904, 1906 extend horizontally and the first and second body portions 1912, 1914 extend downwardly away at an angle from the second portions of the first and second legs 1904, 1906, respectively.

With continuing reference to FIG. 23, the second flange 1918 includes a convex eyelash contact surface 1946 facing toward the first flange 1916 when the first and second legs 1904, 1906 are locked together. In the side view illustrated in FIG. 23, the eyelash contact surface 1946 defines an arc or curve, and a chord line 1948 may be drawn from the outer end of the arc to the inner end of the arc, which is defined by a point at which the arc intersects a planar part of the second body portion 1914. The chord line 1948 is substantially parallel to an adjacent part of the second body portion 1914. Other configurations are possible depending on the usage requirement or preferences for the particular applicator 1902, including configurations where the chord line 1948 is angled relative to the adjacent part of the second body portion 1914.

According to certain embodiments, the applicator 1902 is removably coupled to the packaging trays 100, 1100. In further embodiments, at least one applicator 1902 is coupled to the packaging tray 100, 1100 through at least one frangible joint, and is removable from the packaging tray 100, 1100 when the at least one frangible joint is broken. The set of artificial eyelashes 1930 may remain disposed on and adhered to the applicator 1902 while the frangible joint is being broken.

To apply the set of artificial eyelashes 1930 with the applicator 1902, an adhesive at the proximal portion 1932 of the set of artificial eyelashes 1930 is activated, by moisture for example. The user then rotates the second leg 1906 toward the first leg 1904 about the rotational axis 1910, and rotates the catch mechanism 1938, thereby locking the first and second legs 1904, 1906 together. The set of artificial eyelashes 1930 is then applied to the user's eyelid, for example by grasping the raised surfaces 1928 using the thumb and index finger, and placing the proximal portion 1932 of the set of artificial eyelashes 1930 on the user's eyelid. When the set of artificial eyelashes 1930 are adhered to the user's eyelid, the applicator 1902 is removed from the set of artificial eyelashes 1930. The applicator 1902 is able to be removed because the adhesive between the set of artificial eyelashes 1930 and the first flange 1916 has a lower tackiness than the adhesive between the set of artificial eyelashes 1930 and the user's eyelid.

Although the embodiments of the present disclosure describe a specific configuration of first and second legs 1904, 1906 extending from the first and body portions 1912, 1914 of the applicator 1902, any number or configuration of legs may be used that allow for proper application of the artificial eyelash. For example, embodiments of the present disclosure can include an applicator having side legs in addition to the first and second legs 1904, 1906.

The artificial eyelash applicator of the present disclosure may have a cover layer disposed on top of an adhesive layer. The cover layer may be removed to expose the adhesive layer beneath. The embodiments of the present disclosure are not limited to the shape, size or number of exposed adhesive portions. Specifically, any shape, configuration or number of exposed portions of adhesive layer may be used that achieve the object of the present disclosure.

While the invention has been shown and described with reference to certain embodiments thereof, it will be understood by those skilled in the art that various changes in form and detail may be made therein without departing from the spirit and scope of the invention as defined by the appended claims and their equivalents.

The invention claimed is:

1. An applicator for artificial eyelashes, the applicator comprising:

a first leg comprising a first portion providing a proximal end of the first leg and a second portion providing a distal end of the first leg, wherein the first leg has an inner surface opposite an outer surface;

a first body portion extending distally from the distal end of the first leg;

a first flange extending distally from the first body portion, the first flange having a concave inner surface and a convex outer surface, wherein the first leg, first body portion and first flange define a first unitary structure;

a second leg comprising a first portion providing a proximal end of the second leg and a second portion providing a distal end of the second leg, wherein the second leg has an inner surface opposite an outer surface;

a second body portion extending distally from the distal end of the second leg;

a second flange extending distally from the second body portion, the second flange having a concave outer surface and a convex inner surface, wherein and the second leg, second body portion and second flange define a second unitary structure;

a hinge joint formed between the proximal ends of the first and second legs such that the first and second unitary structures are pivotable between a closed configuration and an open configuration; and a coupling mechanism comprising (i) a hook extending from the inner surface of the second leg toward the first leg, and (ii) an opening with a catch mechanism positioned on the first leg, wherein the opening extends from the inner surface of the first leg through an entire thickness of the first leg to the outer surface of the first leg, wherein, in the open configuration, the inner surfaces of the first and second legs are spaced apart from one another and the hook is detached from the catch mechanism so as to detach the first leg from the second leg, wherein, in the closed configuration:

the concave inner surface of the first flange matingly receives the convex inner surface of the second flange, a gap exists between at least a portion of the inner surfaces of the first and second body portions, the inner surfaces of the first and second legs are in abutting contact, and the hook extends through the opening such that a portion of the hook is disposed adjacent the outer surface of the first leg and the hook engages the catch mechanism to lock the first and second legs together, wherein the first and second flanges are configured to secure the artificial eyelash between the respective inner surfaces thereof in the closed configuration, during use, wherein the first portions of the first and second legs so as to extend vertically upward at an angle from the proximal end toward the second portion of the first and second legs, respectively, wherein the second portions of the first and second legs extend horizontally, and wherein the first and second body portions extending downwardly away at an angle from the second portions of the first and second legs, respectively.

2. The applicator of claim 1, wherein, in operation and when the first and second legs are locked together, a portion of the set of eyelashes extends within the gap.

3. The applicator of claim 1, wherein the hinge joint defines a rotation axis, and wherein the first and second flanges each define a concave arc lying in a section plane that is coplanar with the rotation axis.

4. The applicator of claim 1, wherein the hinge joint defines a rotational axis, wherein the first leg defines a first leg width, the first body portion defines a first body portion width, the first leg width and the first body portion width being along a direction substantially parallel to the rotational axis, and wherein the first leg width is about one third or more of the first body portion width.

5. The applicator of claim 1, wherein the hinge joint defines a rotational axis, wherein the second leg defines a second leg width, and the second body portion defines a second body portion width, both the second leg width and the second body portion width being along a direction substantially parallel to the rotational axis, and wherein the second leg width is about one third or more of the second body portion width.

6. The applicator of claim 1, wherein the hinge joint defines a rotational axis, wherein each of the first and second legs defines a first width at the first portion that is closer to the hinge joint and a second width at the second portion that is farther from the hinge joint, both the first and second widths of the first and second legs being along a direction substantially parallel to the rotational axis, and wherein the first width of the first leg and the first width of the second leg are substantially the same, and the second width of the first leg and the second width of the second leg are substantially the same.

7. The applicator of claim 1, further comprising an adhesive layer disposed on the first flange.

8. The applicator of claim 7, further comprising a cover layer disposed over the adhesive layer.

9. The applicator of claim 1, wherein the first body portion defines a first body portion width, and wherein the first leg defines a first leg width that is about one third or more of the first body portion width.

10. The applicator of claim 1, wherein the second body portion defines a second body portion width, and wherein the second leg defines a second leg width that is about one third or more of the second body portion width.

11. The applicator of claim 1, wherein a curvature of the concave outer surface of the second flange curves away from the second body portion.

12. A kit for artificial eyelashes, the kit comprising:

a packaging tray; and an applicator comprising:

a first leg comprising a first portion providing a proximal end of the first leg and a second portion providing a distal end of the first leg, wherein the first leg has an inner surface opposite an outer surface, a first body portion extending distally from the distal end of the first leg, a first flange extending distally from the first body portion, the first flange having a concave inner surface and a convex outer surface, wherein the first leg, first body portion and first flange define a first unitary structure, a second leg comprising a first portion providing a proximal end of the second leg and a second portion providing a distal end of the second leg, wherein the second leg has an inner surface opposite an outer surface, a second body portion extending distally from the distal end of the second leg;

a second flange extending distally from the second body portion, the second flange having a concave outer surface and a convex inner surface, wherein and the second leg, second body portion and second flange define a second unitary structure, a hinge joint formed between the proximal ends of the first and second legs such that the first and second unitary structures are pivotable between a closed configuration and an open configuration, and a coupling mechanism comprising (i) a hook extending from the inner surface of the second leg toward the first leg, and (ii) an opening with a catch mechanism positioned on the first leg, wherein the opening extends from the inner surface of the first leg through an entire thickness of the first leg to the outer surface of the first leg, wherein, in the open configuration, the inner surfaces of the first and second legs are spaced apart from one another and the hook is detached from the catch mechanism so as to detach the first leg from the second leg, wherein, in the closed configuration:

the concave inner surface of the first flange matingly receives the convex inner surface of the second flange, a gap exists between at least a portion of the inner surfaces of the first and second body portions, the inner surfaces of the first and second legs are in abutting contact, and the hook extends through the opening such that a portion of the hook is disposed adjacent the outer surface of the first leg and the hook engages the catch mechanism to lock the first and second legs together, wherein the first and second flanges are configured to secure the artificial eyelash between the respective inner surfaces thereof in the closed configuration, during use, wherein the first portions of the first and second legs so as to extend vertically upward at an angle from the proximal end toward the second portion of the first and second legs, respectively, wherein the second portions of the first and second legs extend horizontally, and wherein the first and second body portions extending downwardly away at an angle from the second portions of the first and second legs, respectively.

13. The kit of claim 12, wherein the hinge joint defines a rotation axis, and wherein the first and second flanges each define a concave arc lying in a section plane that is coplanar with the rotation axis.

14. The kit of claim 12, wherein the hinge joint defines a rotational axis, wherein the first leg defines a first leg width, the first body portion defines a first body portion width, the first leg width and the first body portion width being along a direction substantially parallel to the rotational axis, and wherein the first leg width is about one third or more of the first body portion width.

15. The kit of claim 12, wherein the hinge joint defines a rotational axis, wherein the second leg defines a second leg width, and the second body portion defines a second body portion width, both the second leg width and the second body portion width being along a direction substantially parallel to the rotational axis, and wherein the second leg width is about one third or more of the second body portion width.

16. The kit of claim 12, wherein the hinge joint defines a rotational axis, wherein each of the first and second legs defines a first width at the first portion that is closer to the hinge joint and a second width at the second portion that is farther from the hinge joint, both the first and second widths of the first and second legs being along a direction substantially parallel to the rotational axis, and wherein the first width of the first leg and the first width of the second leg are substantially the same, and the second width of the first leg and the second width of the second leg are substantially the same.

17. The kit of claim 12, wherein the applicator further comprises an adhesive layer disposed on the first flange.

18. The kit of claim 17, wherein the applicator further comprises a cover layer disposed over the adhesive layer.

19. The kit of claim 12, wherein the first body portion defines a first body portion width, and wherein the first leg defines a first leg width that is about one third or more of the first body portion width.

20. The kit of claim 12, wherein the second body portion defines a second body portion width, and wherein the second leg defines a second leg width that is about one third or more of the second body portion width.

21. The kit of claim 12, wherein a curvature of the concave outer surface of the second flange curves away from the second body portion.

* * * * *